US005444606A

United States Patent [19]

Barnes et al.

[11] Patent Number: 5,444,606

[45] Date of Patent: Aug. 22, 1995

[54] PRISMATIC REFLECTOR AND PRISMATIC LENS

[75] Inventors: Josh T. Barnes; Paul C. Belding, both of Charlevoix, Mich.

[73] Assignee: Lexalite International Corporation, Charlevoix, Mich.

[21] Appl. No.: 195,363

[22] Filed: Feb. 10, 1994

[51] Int. Cl.[6] ..... F21V 5/02

[52] U.S. Cl. ..... 362/340; 362/309; 362/311; 362/329; 362/348

[58] Field of Search ..... 362/299, 300, 307–311, 362/329, 333, 334, 336, 337, 339, 340, 348

[56] References Cited

U.S. PATENT DOCUMENTS

| | | | |
|---|---|---|---|
| 549,975 | 11/1895 | Orebaugh et al. | 362/329 |
| 563,836 | 7/1896 | Blondel et al. | 362/334 |
| 1,447,500 | 3/1923 | Ainsworth | 362/304 |
| 1,548,252 | 8/1925 | Breuss | 362/334 |
| 1,708,108 | 4/1929 | Rolph | 116/63 R |
| 1,745,278 | 1/1930 | Sisson | 362/336 |
| 2,011,678 | 8/1935 | Downer | 362/300 |
| 2,029,929 | 2/1936 | Luce | 359/534 |
| 2,566,126 | 8/1951 | Franck | 362/309 |
| 2,686,255 | 8/1954 | Pascucci | 362/337 |
| 2,887,568 | 5/1959 | Franck | 362/309 |
| 3,089,024 | 5/1963 | Odle | 362/309 |
| 3,160,350 | 12/1964 | Rex et al. | 362/340 |
| 3,187,177 | 6/1965 | Meyer | 362/340 |
| 3,283,138 | 11/1966 | Huber et al. | 362/340 |
| 3,283,140 | 11/1966 | Rex | 362/309 |
| 3,384,743 | 5/1968 | Little et al. | 362/297 |
| 3,398,273 | 8/1968 | Rex et al. | 362/309 |
| 3,398,274 | 8/1968 | Rex | 362/348 |
| 3,532,871 | 10/1970 | Shipman | 362/80 |
| 3,686,495 | 8/1972 | Medley | 362/223 |
| 3,701,896 | 10/1972 | Pate | 362/224 |
| 3,886,347 | 5/1975 | Dorman | 362/311 |
| 3,999,054 | 12/1976 | Dorman | 362/299 |
| 4,023,031 | 5/1977 | Storey | 362/281 |
| 4,027,151 | 5/1977 | Barthel | 362/217 |
| 4,158,222 | 6/1979 | Cook | 362/269 |
| 4,164,012 | 8/1979 | Gulliksen | 362/282 |
| 4,173,037 | 10/1979 | Henderson, Jr. et al. | 362/287 |
| 4,249,234 | 2/1981 | Park et al. | 362/228 |
| 4,262,326 | 4/1981 | Lewin | 362/223 |
| 4,373,178 | 2/1983 | Gulliksen | 362/280 |
| 4,379,322 | 4/1983 | Kelly | 362/300 |
| 4,420,800 | 12/1983 | Van Horn | 362/297 |
| 4,420,801 | 12/1983 | Reiling et al. | 362/297 |
| 4,545,007 | 10/1985 | Nagel | 362/329 |
| 4,563,730 | 1/1986 | Saito | 362/264 |
| 4,600,979 | 7/1986 | Fisher et al. | 362/373 |
| 4,683,525 | 7/1987 | Camm | 362/346 |
| 4,729,071 | 3/1988 | Solomon | 362/35 |
| 4,731,714 | 3/1988 | Kelly et al. | 362/310 |
| 4,816,976 | 3/1989 | Fouke et al. | 362/309 |
| 4,839,781 | 6/1989 | Barnes et al. | 362/299 |
| 5,046,818 | 9/1991 | Barnes | 359/527 |
| 5,143,446 | 9/1992 | Barnes et al. | 362/293 |

FOREIGN PATENT DOCUMENTS

| | | | |
|---|---|---|---|
| 385527 | 12/1932 | United Kingdom | 362/300 |
| 516361 | 1/1940 | United Kingdom | 362/300 |

*Primary Examiner*—Ira S. Lazarus
*Assistant Examiner*—Alan B. Cariaso
*Attorney, Agent, or Firm*—Mason, Kolehmainen, Rathburn & Wyss

[57] ABSTRACT

A combination of a prismatic reflector and a prismatic lens is provided for use with lighting fixtures. A reflector body has a substantially parabolic contour defining an interior cavity. The reflector body includes a plurality of prisms for receiving, transmitting and reflecting light. A lens body has a first mating surface engaging the reflector body, an opposed inverted conical surface, and a sloping sidewall extending between the mating surface and the opposed inverted conical surface. The mating surface of the lens body has a larger diameter than the opposed inverted conical surface. The opposed inverted conical surface includes a plurality of prisms for receiving and for redirecting light.

11 Claims, 6 Drawing Sheets

PRISMATIC REFLECTOR AND PRISMATIC LENS

BACKGROUND OF THE INVENTION

1. Field of the Invention

The present invention relates generally to reflectors, and more particularly to a combination of a prismatic reflector and a prismatic lens used with lighting fixtures.

2. Description of the Prior Art

Various known reflector arrangements are used to provide a desired lighting distribution of a particular application.

U.S. Pat. No. 4,839,781 issued Jun. 13, 1989 and assigned to the assignee of the present invention, discloses a reflector/refractor device for use with a variety of lighting fixtures and light sources. The reflector/refractor device has a predetermined profile and predefined sectional zones. Each sectional zone has predetermined light distribution characteristics. The reflector/refractor device provides a predetermined light distribution characteristic by a vertical movement of an illuminating lamp source.

U.S. Pat. No. 5,046,818 issued Sep. 10, 1991 and assigned to the assignee of the present invention, discloses an optical system for traffic signal devices including a reflector and a lens.

While the prismatic reflectors disclosed by the above-identified patents provide improvements over prior art arrangements, it is desirable to provide a combination of a prismatic reflector and a prismatic lens that provides improved controlled light distribution, particularly for industrial and commercial lighting and low-bay applications.

SUMMARY OF THE INVENTION

Among the principal objects of the present invention are to provide a combination of a prismatic reflector and a prismatic lens used with lighting fixtures overcoming many of the disadvantages of known reflector arrangements.

In brief, the objects and advantages of the present invention are achieved by a combination of a prismatic reflector and a prismatic lens used with lighting fixtures. A reflector body has a substantially parabolic contour defining an interior cavity. The reflector body includes a plurality of prisms for receiving, transmitting and reflecting light. A lens body has a first mating surface engaging the reflector body, an opposed inverted conical surface, and a sloping sidewall extending between the mating surface and the opposed inverted conical surface. The mating surface of the lens body has a larger diameter than the opposed inverted conical surface. The opposed inverted conical surface includes a plurality of prisms for receiving and for redirecting light.

BRIEF DESCRIPTION OF THE DRAWING

The present invention together with the above and other objects and advantages may best be understood from the following detailed description of the embodiment of the invention illustrated in the drawing, wherein.

DETAILED DESCRIPTION OF THE PREFERRED EMBODIMENT

Figure 1:
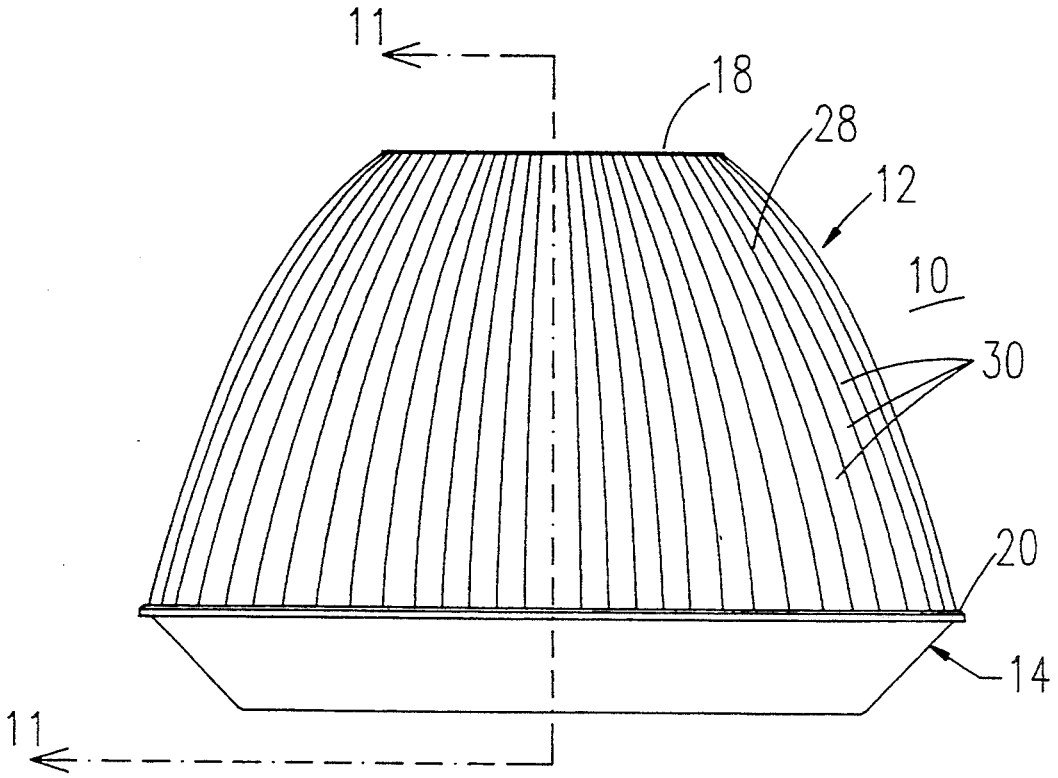
FIG. 1 is a perspective view illustrating a prismatic reflector and a prismatic lens combination of the invention.

Referring now to the drawings, in FIG. 1 there is illustrated a combination generally designated by the reference character 10 of a prismatic reflector 12 and a prismatic lens 14 constructed in accordance with the principles of the present invention. Prismatic reflector and prismatic lens combination 10 provides improved light distribution, particularly for low-bay industrial and commercial lighting applications. Prismatic reflector and prismatic lens combination 10 provides a symmetrical light distribution.

Figure 2:
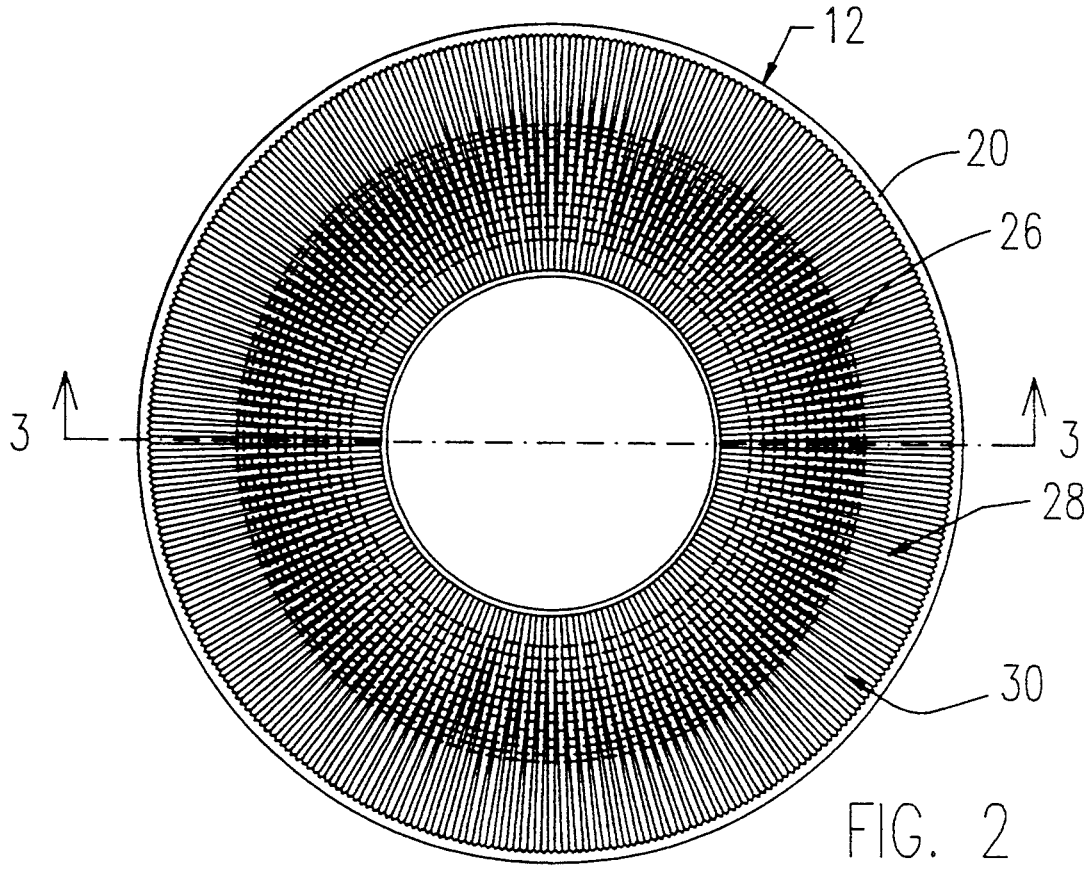
FIG. 2 is a top plan view, with interior detail shown in dotted line, of the prismatic reflector and a prismatic lens of FIG. 1.
Figure 4:
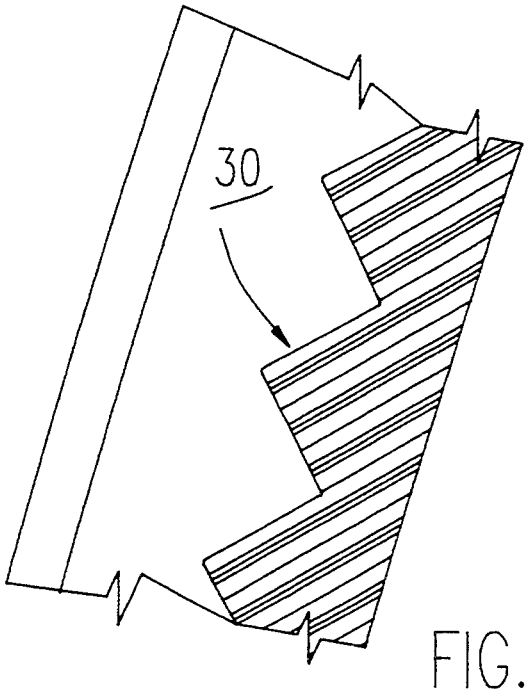
FIG. 4 is a cross-sectional view along the line 4—4 of FIG. 3.
Figure 3:
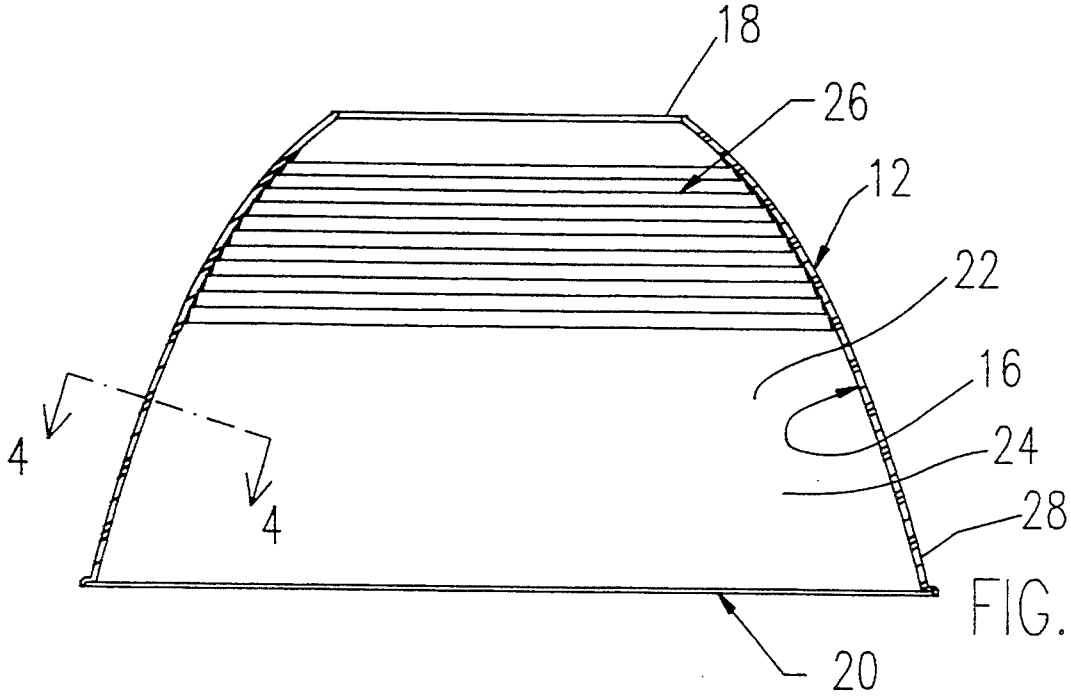
FIG. 3 is a cross-sectional view taken along the line 3—3 of FIG. 2.
Figure 5:
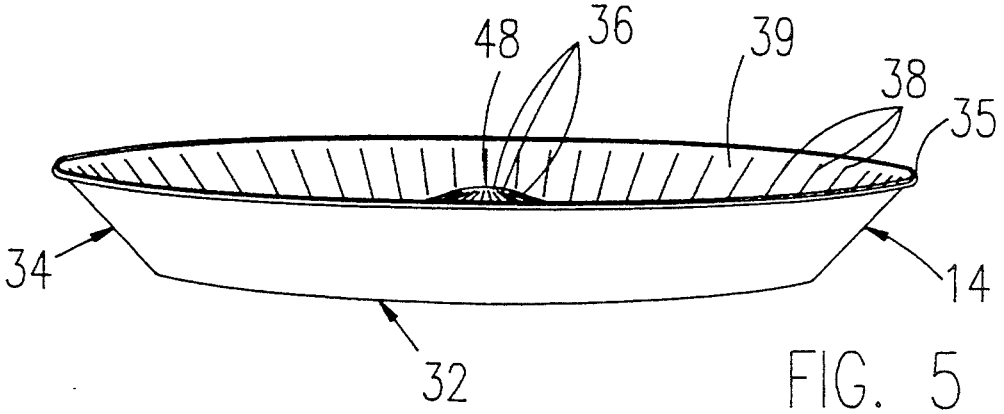
FIG. 5 is a perspective view of the prismatic lens of FIG. 1.
Figure 6:
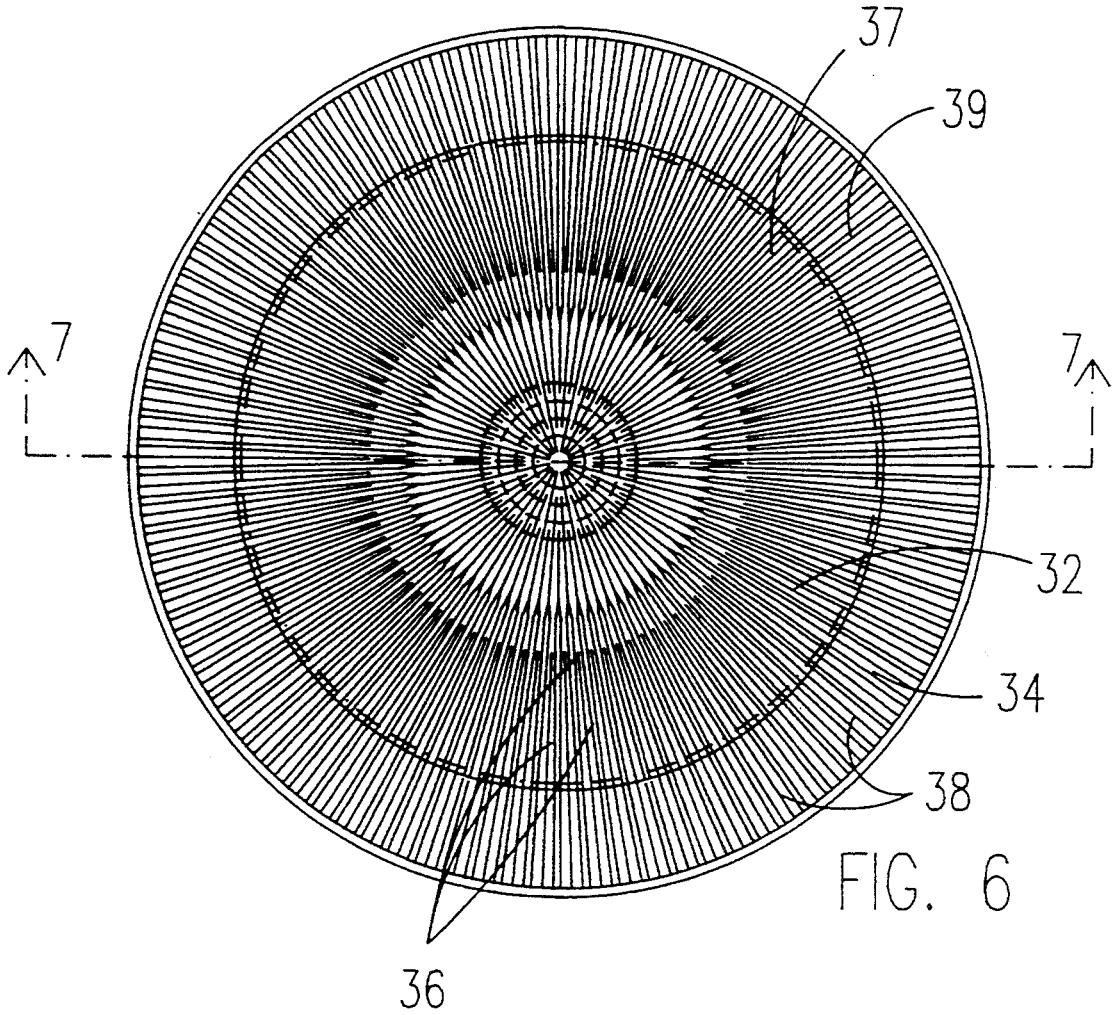
FIG. 6 is a top plan view, with exterior detail shown in dotted line, of the prismatic lens of FIG. 5.

Referring also to FIGS. 2, 3 and 4, reflector 12 comprises a unitary body having a substantially parabolic contour and defining an interior cavity 16. A light source or lamp (not shown) is disposed along a central vertical axis within the prismatic reflector 12. Reflector 12 preferably is formed of a light transmitting synthetic resin material, such as, for example, an acrylic or similar material. Reflector 12 has a central circular top wall 18 and a bottom wall 20. An inside surface 22 of the reflector 12 includes a smooth, light receiving, lower surface portion 24 and an optional light depressing prism portion 26. The optional prisms 26 provide modest or slight light spreading for additional light rays near Nadir. An outside surface 28 of the reflector 12 is formed with a plurality of substantially vertical critical angle reflecting prisms 30. Critical angle reflecting prisms 30 consist of calculated curved and angled surfaces such that internal rays impinging thereon will be reflected or refracted as the incident angle is greater than or less than the critical angle of the transparent material (42.2 degrees for acrylic). A prismatic reflector and critical angle reflecting prisms that can be used for the reflector 12 and prisms 30 are disclosed in U.S. Pat. No. 4,839,781 issued Jun. 13, 1989 to Barnes et al. and assigned to the present assignee. The disclosure of this patent is incorporated herein by reference.

Figure 8:
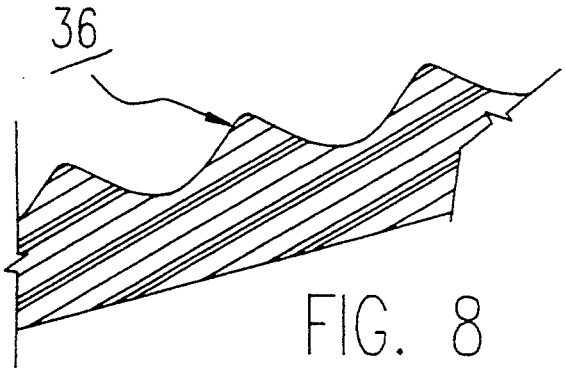
FIG. 8 is a greatly enlarged fragmentary cross-sectional view along the line 8—8 of FIG. 7.
Figure 9:
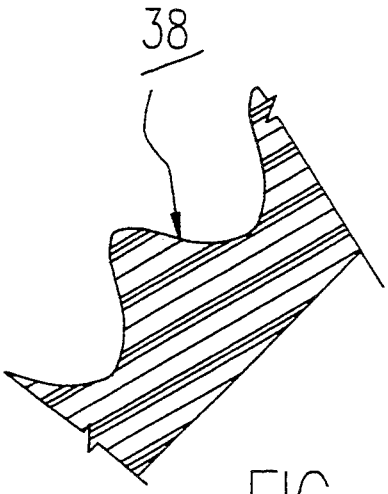
FIG. 9 is a greatly enlarged fragmentary cross-sectional view along the line 9—9 of FIG. 7.
Figure 10:
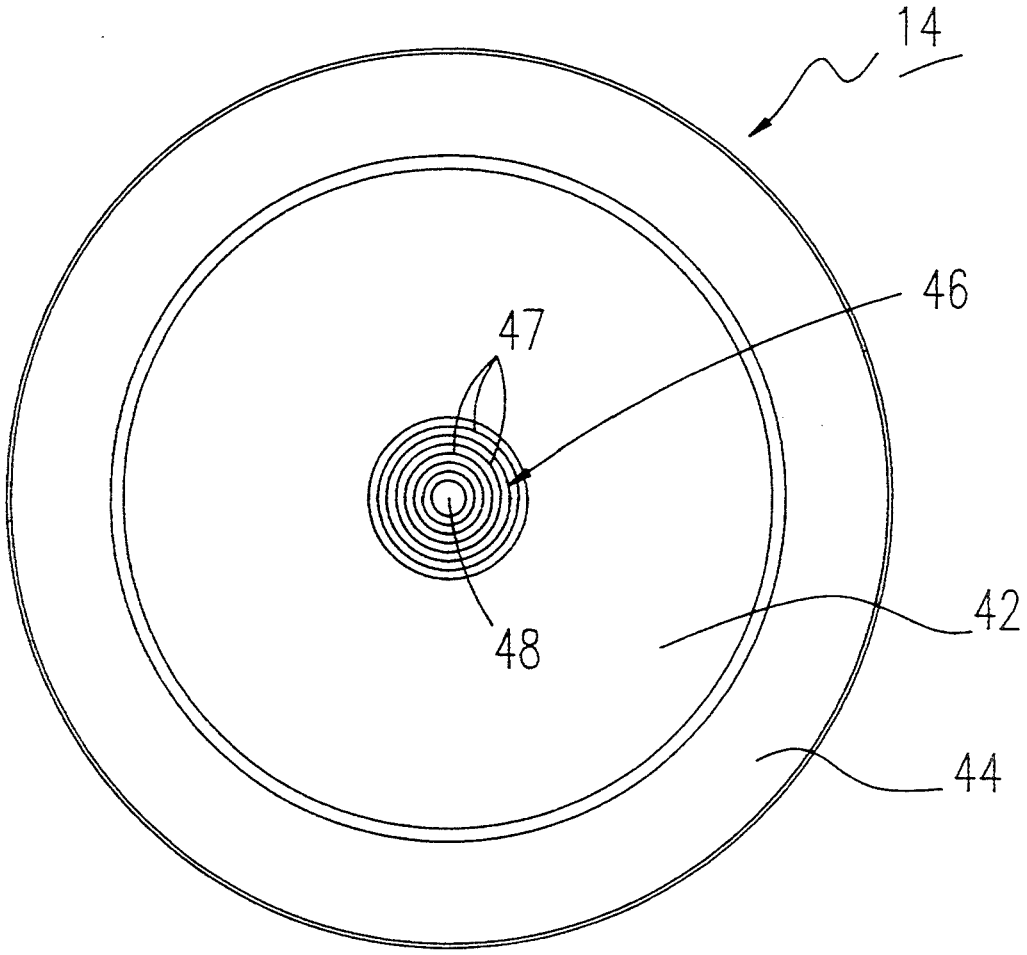
FIG. 10 is a bottom plan view of the prismatic lens of FIG. 5.

Referring to FIGS. 5–10, there is shown the prismatic lens 14 arranged in accordance with the invention. Prismatic lens 14 provides much better light control than a conventional low-bay lens. Prismatic lens 14 is generally configured for normal incidence of light rays. Prismatic lens 14 includes an inverted conical lower portion generally designated by 32, a sloped sidewall generally designated by 34 and an upper mating face 35 for engagement with the lower surface 20 of the prismatic reflector 12. Prismatic lens 14 includes a first-type prism 36 on an upper surface 37 of lower portion 32 and a second-type prism 38 on the upper surface 39 of the sloped sidewall 34. Referring to FIG. 10, both an outside or lower surface 42 of the inverted conical lower portion 32 and an outside or lower surface of the sloped sidewall 34 are generally smooth surfaces. A centrally located outside or lower sector 46 includes annular horizontal light depressing prisms 47 disposed around a central peak 48 of the inverted conical lower portion 32 of the lens 14. Prisms 47 are optionally provided within the lower portion 32. Prisms 47 provide moderate or slight spreading of the incident light rays.

Referring now to FIG. 8, there is shown greatly enlarged the first-type prism 36. Prisms 36 provide significant spreading of the incident light rays. In FIG. 9, the second-type prism 38 is shown greatly enlarged. Prisms 38 also provide significant spreading of the incident light rays.

Prismatic lens 14 and the prismatic reflector 12 are formed of a light transmitting synthetic resin material, such as, for example, an acrylic UVA5 or similar material. Alternatively, a clear polycarbonate material can be used to form the prismatic lens 14 and the prismatic reflector 12; however, the polycarbonate material is subject to yellowing when used with a high ultraviolet (UV) output light source; and this yellowing effect is enhanced at high temperatures. Prismatic reflector 12 and lens 14 can be molded from a KAMAX T-240-100 material manufactured by AtoHaas of Philadelphia, Pa. for improved yellowing resistance over polycarbonate materials in most applications. Prismatic lens 14 and the prismatic reflector 12 are formed by an injection molding technique.

Figure 7:
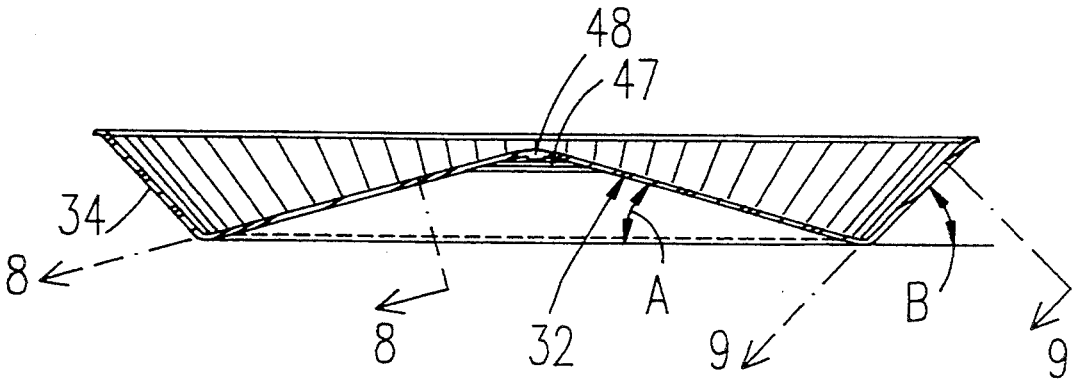
FIG. 7 is a cross-sectional view along the line 7—7 of FIG. 6.

Prismatic reflector 12 and lens 14 can be used, for example, with a 400 watt phosphor coated metal halide lamp where the diameter of the upper mating face 35 and the bottom wall 20 is about 61.98 centimeters (24.4 inches) and the diameter of the top wall 18 is 25.60 centimeters (10.08 inches). For such example, the outside diameter of the inverted conical portion 32 of the lens 14 can be 48.31 centimeters (19.02 inches) with the lower portion 32 spaced apart from the upper mating face 35 by 7.62 centimeters (3.0 inches), an angle A of 15.3° and an angle B of 45.5°, as indicated in FIG. 7

Figure 11:
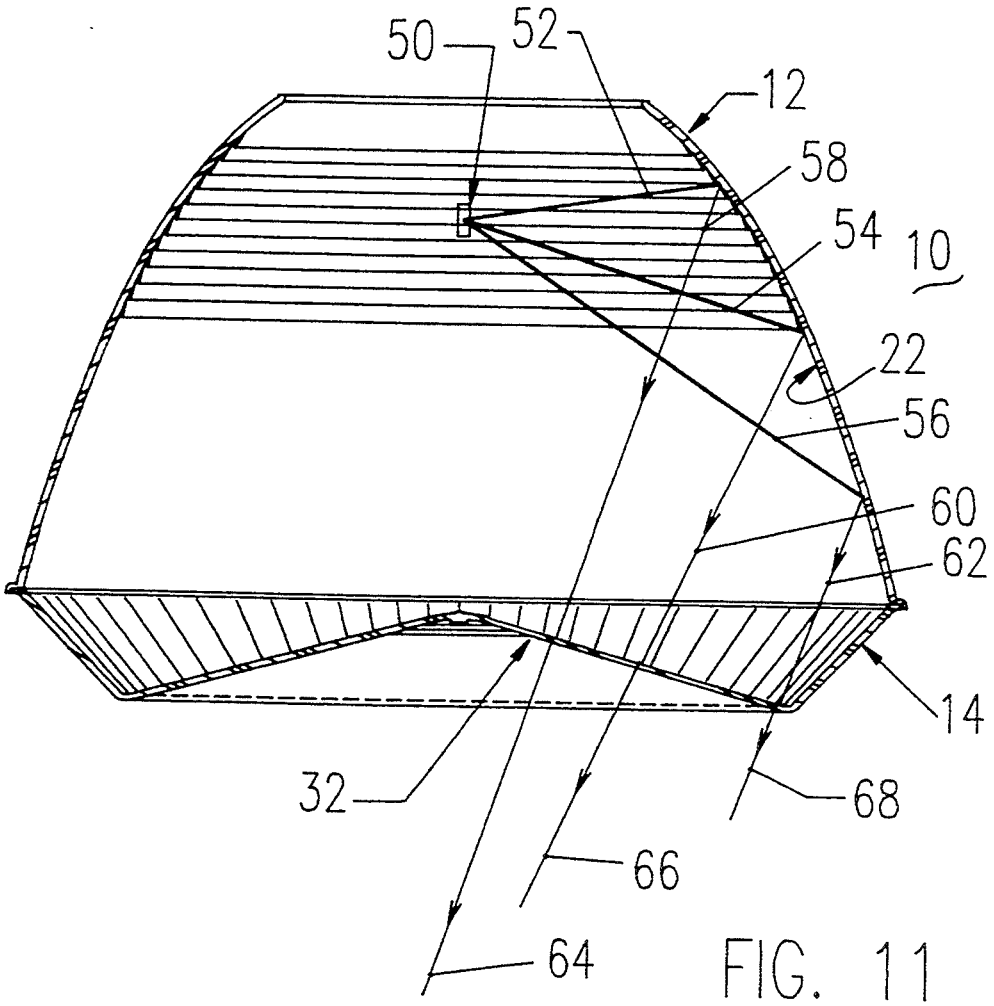
FIG. 11 is a cross-sectional view similar to FIGS. 3 and 7 combined, illustrating the improved function of the prismatic lens of the invention.

FIG. 11 is a cross-sectional view of the combination 10 of the reflector 12 and lens 14 with typical reflected light ray traces and best illustrates the unusual features that are the basis for the high efficiency and ray control of the unique construction of the invention. As shown in FIG. 11 for purposes of clarity, the direct ray traces, those that are emitted by the light source and make first contact on the lens inner surface, are omitted; and only the rays that make first contact on the reflector surface 22, and then are reflected to the lens 14, are shown. Surface 32 intercepts generally perpendicular to the reflected rays from the reflector 12. Incident reflected rays are normal to the inverted conical surface 32 of the prismatic lens 14. Thus the inverted conical surface 32 is arranged to provide improved light distribution and lower loss.

The emitted rays, such as 52, 54 and 56, from a lamp 50 to near the top, at the middle and near the bottom of the reflector 12 respectively, are reflected to the near side, inner surface of the inverted cone 32 as rays 58, 60 and 62, also respectively. It is noted that these rays are incident to this surface at angles near normal to the surface. Such near normal angles reduce first surface reflections to near zero, virtually eliminate refraction losses and permit maximum control of the ray as it is transmitted through the lens and is then emitted from the opposed outer surface as rays 64, 66 and 68. The bending of these rays by lens 14 is toward and away from the viewer and is not depicted on this two dimensional view. The measured total (0° through 180°, vertical) efficiency is in excess of 90% despite the high level of ray control provided by the assembly 10. This high level of control, together with the designed uplight component, both enhanced by this construction, result in typical maximum to minimum uniformity ratios of less than 3:1 with Spacing Criteria of up to 1.8 to 1.

While the invention has been described with reference to details of the illustrated embodiment, these details are not intended to limit the scope of the invention as defined in the appended claims.

We claim:

1. In combination, a prismatic reflector and a prismatic lens comprising:

a reflector body having a predetermined contour and defining an interior cavity;

a light source for emitting light disposed within said interior cavity;

said reflector body including a plurality of prism means for receiving, transmitting and reflecting said emitted light and said reflector body having a circular bottom wall;

a lens body having a first upper circular mating surface engaging said circular bottom wall of said reflector body, a downwardly depending sidewall and a second lower conical portion joining a lower peripheral edge of said sidewall and said conical portion sloping inwardly and upwardly toward said upper mating surface; and said conical portion having an upper surface being generally perpendicular to received reflected light from said reflector body and including a plurality of first prism means for receiving and for redirecting reflected light from said reflector body.

2. A combination as recited in claim 1 wherein said reflector body has a contour such that the majority of the reflected light from said reflector body is directed to said upwardly and inwardly sloping conical portion upper surface with an angle of incidence of the reflected light near normal to said conical portion upper surface.

3. A combination as recited in claim 1 wherein said downwardly depending sidewall slopes inwardly and said inwardly sloping sidewall includes a plurality of second prism means for receiving and for redirecting reflected light from said reflector body.

4. A combination as recited in claim 3 wherein said second prism means included on said sloping sidewall are light spreading prisms.

5. A combination as recited in claim 1 wherein said first prism means included on said conical portion upper surface of said lens body provide significant light spreading.

6. A combination as recited in claim 1 wherein said conical portion upper surface includes a central portion disposed in a plane adjacent said mating surface.

7. A combination as recited in claim 1 wherein said downwardly depending sidewall further includes second prism means formed on said sidewall and said mating surface having a larger diameter than said conical portion upper surface.

8. In combination, a prismatic reflector and a prismatic lens comprising:

a reflector body having a predefined contour and defining an interior cavity;

a light source for emitting light disposed within said interior cavity;

said reflector body including a plurality of prism means for receiving, transmitting and reflecting emitted light and said reflector body having a circular bottom wall;

a lens body having a first upper circular mating surface engaging said circular bottom wall of said reflector body and a second lower conical portion having an inside surface and an outside surface and a sloping sidewall extending between said upper mating surface and said second lower conical portion, said mating surface of said said conical portion;

said predetermined contour of said reflector body and said second lower conical portion being arranged for providing said second lower conical portion inside surface generally perpendicular to said reflected light from said reflector body; and said inside surface of said second lower conical portion including a plurality of light spreading prism means for receiving and for redirecting reflected light from said reflector body to provide light spreading.

9. A combination as recited in claim 8 wherein said lens body is formed by injection molding technique.

10. A combination as recited in claim 8 wherein said lens body is formed of a substantially transparent acrylic material.

11. A combination as recited in claim 10 wherein said reflector body is formed of a substantially transparent acrylic material.

* * * * *